United States Patent [19]

Waitzman

[11] Patent Number: 4,511,041

[45] Date of Patent: Apr. 16, 1985

[54] JEWELRY DISPLAY TRAY AND SECURITY SYSTEM

[76] Inventor: Michael D. Waitzman, 11762 Iowa Ave., No. 8, West Los Angeles, Calif. 90025

[21] Appl. No.: 575,074

[22] Filed: Jan. 30, 1984

[51] Int. Cl.[3] ..... B65D 1/34; A47F 7/24; E05B 73/00

[52] U.S. Cl. ..... 206/566; 206/560; 206/565; 312/218; 312/219

[58] Field of Search ..... 206/560, 564, 565, 566; 312/218, 219

[56] References Cited

U.S. PATENT DOCUMENTS

| | | | |
|---|---|---|---|
| 142,575 | 9/1873 | Martin et al. | 206/566 |
| 504,167 | 8/1893 | Krueger | 206/566 |
| 732,089 | 6/1903 | Lenzen | 206/560 |
| 914,563 | 3/1909 | Fowler | 206/566 |
| 1,436,233 | 11/1922 | Brown | 206/566 |
| 1,943,099 | 1/1934 | Tobey | 312/219 |
| 1,994,363 | 1/1935 | Kettendorf | 206/566 |
| 2,321,339 | 6/1943 | Wadsworth | 206/566 |
| 3,204,774 | 9/1965 | Barbieri | 206/566 |
| 3,964,603 | 6/1976 | Sandler | 206/560 |
| 4,406,372 | 9/1983 | Bell | 206/566 |

FOREIGN PATENT DOCUMENTS

| | | | |
|---|---|---|---|
| 1520418 | 8/1978 | United Kingdom | 312/218 |

*Primary Examiner*—William T. Dixson, Jr.
*Assistant Examiner*—Brenda J. Ehrhardt
*Attorney, Agent, or Firm*—Philip D. Junkins

[57] ABSTRACT

A jewelry store display tray for displaying finger rings and other jewelry items to customers is provided with a security system for locking rings and such other items into the tray and for locking the tray to security mounts affixed to jewelry display counter tops thereby to prevent thefts of jewelry items and thefts of entire jewelry display trays. Finger activated means are provided to release, from lock condition, the rings or other jewelry items of a given row of rings or other items in the tray and to release the tray from its secured position on a counter top. Key lock means are provided to lock the finger actuated release means against their operation.

6 Claims, 5 Drawing Figures

JEWELRY DISPLAY TRAY AND SECURITY SYSTEM

BACKGROUND OF THE INVENTION

The present invention relates to jewelry display trays and more particularly to display trays for finger rings and other jewelry items including security means for protecting aganist the theft of such rings and other items during their display to, or inspection by, customers in jewelry stores. A common and frequent problem confronting jewelry store operators is the theft of jewelry, particularly finger rings, during their multiple presentation in display trays on counter tops. Professional jewelry thieves need only a split-second of distraction of the attending sales person in which to remove and palm one or more rings or other items on display in the typical jewelry display tray used in most jewelry stores. Even a first-time thief may be presented with opportunity to remove a jewelry item from a display tray without detection.

Ring display trays in common use today carry thirty or more rings in multiple rows of six or more rings each with the finger circling band portion of each ring extending into a slot in the tray and with the head or setting portion of each ring resting on the upper display surface of the tray. Each ring is easily removed from the tray for close inspection by grasping its head or setting portion and lifting same, with its band portion, from the tray slot where it is otherwise seated for display purposes. In most instances the upper display surface of a ring display tray is covered with a soft colored fabric material, such as felt, which protects the precious metal surfaces of each ring from scratches or mars and sets off the head or setting portion of the rings in an attractive display fashion.

SUMMARY OF THE INVENTION

There is a vital need for a security system associated with jewelry display trays used by jewelry stores to protect against the theft of rings or other jewelry items from such trays.

It is an object of the present invention to provide a jewelry display tray which has incorporated within its structure means for locking in the jewelry items held by the tray.

A further object of the invention is to provide a jewelry display tray, for use on counter tops in jewelry stores, in which means are provided to lock the jewelry items within the tray in their respective display position and to selectively release such items for inspection by a customer.

Another object of the present invention is to provide a jewelry display tray in which locking means are arranged within the tray structure for securing the jewelry items held by the tray in their respective display position until released by a sales person for inspection by a customer and in which additional locking means are arranged within the tray structure for securing the tray to the counter top of a jewelry display case.

A still further object of the invention is to provide a jewelry display tray with security means for the jewelry items on display which can be activated or deactivated by a sales person so as to selectively lock the jewelry items within the tray or unlock such items for removal from the tray for inspection by a customer.

In accordance with the invention the interior of a typical jewelers ring display tray is fitted with a parallel series of shiftable ring lock means which are each spring activated into ring-lock positions. Means are provided to selectively move the ring lock means against the pressure of the springs holding same in ring-lock position to ring-unlock position so that ne or more of the rings seated in slots of the display tray may be removed for close viewing and inspection. One or more of the ring lock means are provided with tray lock means for securing the display tray to jewelry display case counter tops. The same means for moving the ring lock means against the pressure of the spring holding same in ring-lock position, upon actuation, releases the tray lock means so that the tray may be removed from its secured position on a counter top. A key actuated locking mechanism for the tray is provided and interacts with the shiftable ring lock means to secure the latter against movement so that no ring may be removed from the tray when such mechanism is in its key-locked position and the tray may not be removed from its placement position on a counter top.

The jewelry display tray and security system of the present invention provides the sales person in a jewelry store with a display system offering high security against the theft of the items on display. The jewelry security system of the invention is easy to operate with respect to locking items within the tray or releasing such items from locked position in the tray for removal and inspection by customers. The sales person interacting with a customer may, in fact, leave the jewelry display tray of the invention on a counter top in front of the customer without fear of the theft of an item from the tray. The display tray and security system of the invention is particularly suitable for displaying finger rings, but may be adopted for the display of other jewelry items, including earrings, watches, etc., so long as such items have a loop, band or ring-type feature in their structure or attachable for display security purposes.

BRIEF DESCRIPTION OF THE DRAWINGS

Referring to the drawings, wherein like characters indicate like parts throughout the figures, the invention is illustrated in the form of a jewelry display tray for finger rings.

DESCRIPTION OF THE PREFERRED EMBODIMENT

Figure 1:
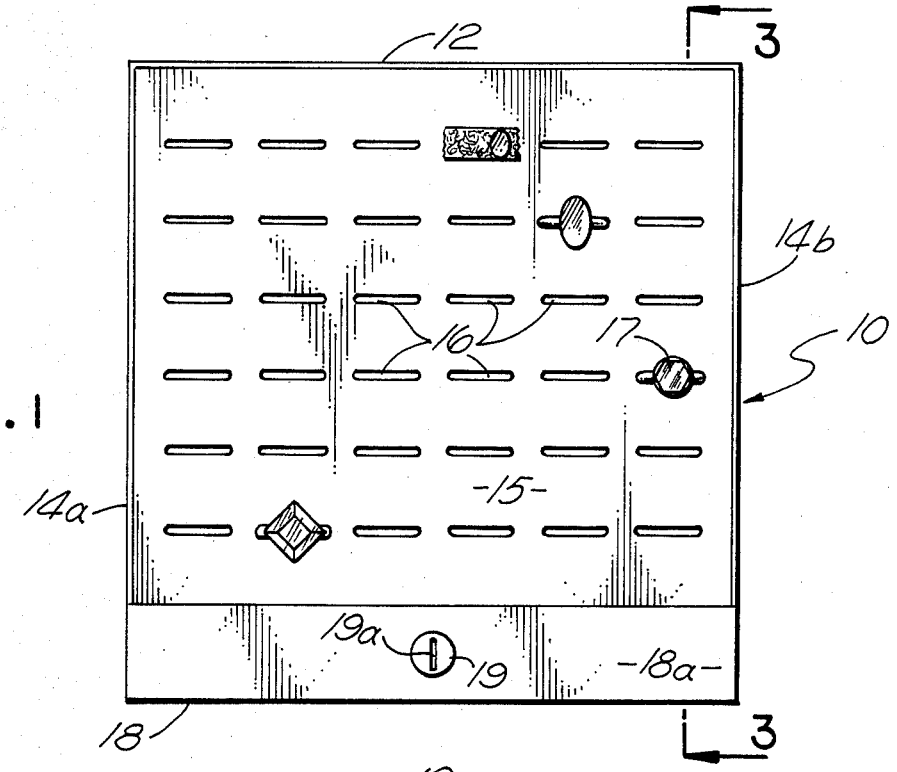
FIG. 1 is a top view of a ring display tray of the present invention.
Figure 2:
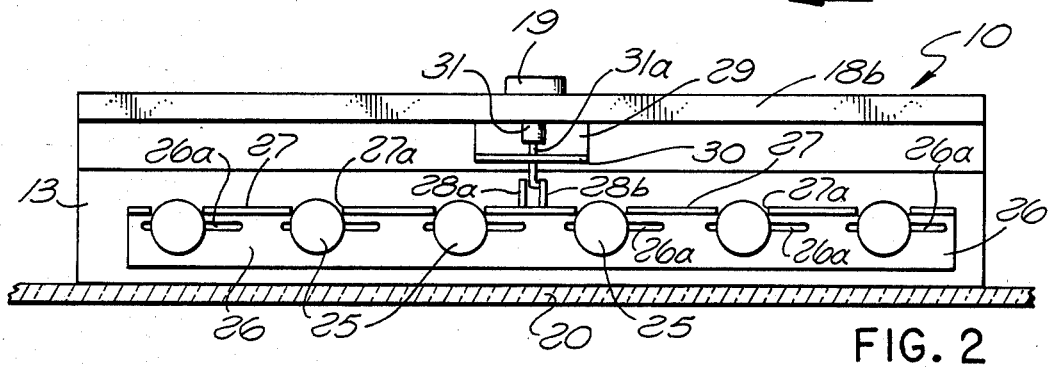
FIG. 2 is an enlarged view of the security control side of the ring display tray of FIG. 1 positioned on the top surface of a jewelry counter top.
Figure 3:
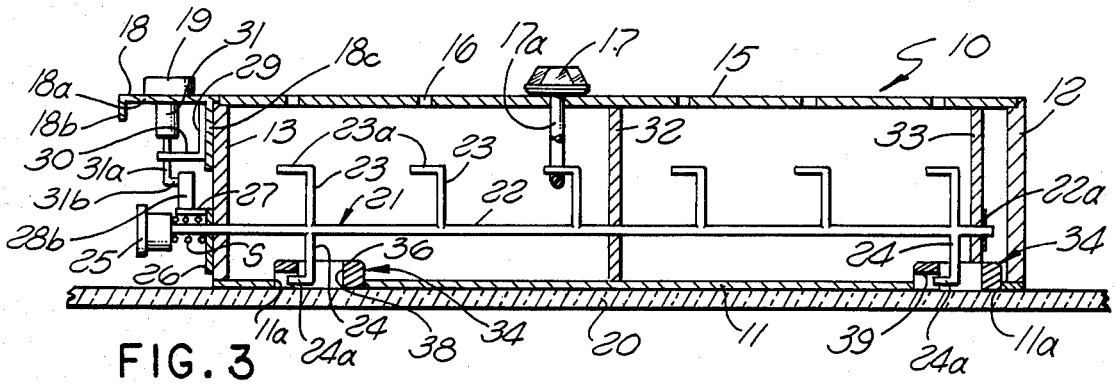
FIG. 3 is an enlarged cross-section view of the ring display tray of FIG. 1, taken at line 3—3, showing the jewelry lock means of the invention.

Referring now to the drawings, there is shown in FIGS. 1, 2 and 3 a ring display tray 10 in accordance with the present invention. The display tray 10 is comprised of a base member 11 to which a front wall 12, a rear wall 13 and side walls **14*a* and 14*b* are upwardly affixed. The front, rear and side walls support a top ring display member 15 which is provided with a plurality of ring slots 16 for receiving the shank or finger circling band portion 17***a* of rings 17. For purposes of orientation of the ring display tray 10 with respect to a a prospective jewelry customer and a jewelry sales person, the front wall 12 of the display tray faces the customer on the front side of a jewelry counter and the rear wall 13 of the display tray faces the sales person or the rear side of a jewelry counter.

Affixed to the rear wall 13 of the ring display tray 10 is a security lock panel member 18 comprised of top plate 18*a*, downwardly depending facing portion 18*b* and downwardly depending mounting portion 18*c*. Mounted on the top plate 18*a* of the security lock panel member 18 is a key lock mechanism 19 of conventional design, including key entry slot 19*a*. FIGS. 2 and 3 show the display tray 10 situated on a jewelry counter top 20.

Within the display tray 10 there are positioned a multiplicity of lock members 21 comprised of rods 22 which are aligned in parallel beneath each row of ring slots 16. The rods 22 bear upwardly extending ring catch elements 23 including catch arms 23*a* which extend within the finger band portions 17*a* of rings 17 when the rods 22 are positioned in ring lock position. One or more of the rods 22 also bear downwardly extending tray security elements 24 which interact, as described hereinafter, to affix the ring display tray 10 to counter top 20. The rods 22 of lock members 21 extend through rear wall 13 and terminate, external to rear wall 13 of display tray 10, in push knobs 25. The rods 22 of lock members 21 also extend through shiftable locking member 26 mounted along the external surface of rear wall 13. Locking member 26 includes knob lock portion 27 which includes knob release spaces 27*a*. Centrally located on knob lock portion 27 of locking member 26 are shift elements 28*a* and 28*b*. Centrally mounted to security lock panel member 18 is key lock bracket 29 including bracket portion 30. Key cylinder 31 is mounted downwardly from plate 18*a* of lock panel member 18 and includes key actuated rotatable pin 31*a* and its shift arm portion 31*b*. The lock members 21, in addition to extending through rear wall 13 of ring display tray 10 and being supported by such wall, extend through, and are supported by, support members 32 and 33. Springs S are positioned about the rearward end of rods 22 between shiftable locking member 26 and push knobs 25 located on the ends of such rods and pressure bias the lock members 21 into ring lock position whereby catch arms 23 are positioned within the finger band portions 17*a* of rings 17. The rods 22 are provided with stop means 22*a* at the forward end of such rods to limit the rearward shiftable movement of same.

Figure 4:
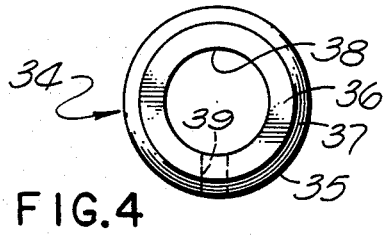
FIG. 4 is a top view of one of the tray mounts which cooperate with the jewelry lock means of the display tray of the present invention.
Figure 5:
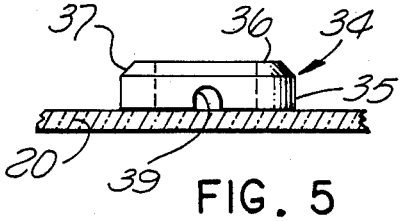
FIG. 5 is a front side view of the tray mount of FIG. 4 positioned on the top surface of a jewelry counter top.

For securing the display tray 10 to a jewelry display case counter top 20 in accordance with the invention, security tray mounts 24 may be affixed to such counter tops (at appropriate locations) by any of the number of well known means. The tray mounts 34, as shown in detail in FIGS. 4 and 5, are rings having an outer surface 35, upper surface 36, bevel surface 37 and inner surface 38 and a channel 39 for receiving catch portion 24*a* of downwardly extending tray security elements 24 affixed to rod 22 of lock members 21.

In operation of the security system of the present invention, jewelry finger rings of high value are situated in the display tray 10 by placement in ring slots 16 with the depending finger band or shank portions 17*a* of each ring extending downwardly below top member 15. As the rings 17 are placed in slots 16 of each aligned row of such slots over a rod 22 of a lock member 21, such lock member is activated forwardly (against biasing spring pressure) by applying finger pressure to the push knob 25 associated with such rod whereby the catch elements carried by the rod are moved forwardly to allow each ring band 17*a* to be fully inserted into a tray slot 16. Following placement of rings into a row of ring slots, the finger pressure, applied to the push knob 25 associated with the lock member 21 in alignment with such rings, is relieved so that the lock member shifts rearwardly and catch arms 23*a* of catch elements 23 extend into and through the finger bands of each ring to lock same within the display tray. In like fashion, the rings in a given row of rings on display in a ring display tray, in accordance with this invention, are released from locked security upon the pressure actuation of the push knob 25 associated with such row of rings. The push knobs 25 may be locked aganist push actuation, to preclude ring release, by shifting the locking member 26 so that knob lock portions 27 of such locking member block forward movement of the push knobs. In this regard, locking member 26 is shifted toward side wall 14*a* to its knob lock position by actuation of a locking key inserted into key slot 19*a* of lock mechanism 19 and the rotation thereby of pin 31*a* and angular movement of shift arm 31*b* which applies shifting force to shift element 28*a* mounted on such locking member 26. The shiftable locking member 26 is permitted to move toward or from side walls 14*a* and 14*b* because it is mounted and rides on rods 22 via slotted openings 26*a* and is held in position against rear wall 13 by the multiplicity of springs S surrounding rods 22 at their push knob ends. To unlock the push knobs 25 the locking key is again inserted into key slot 19*a* of the lock mechanism 19 and rotated in a direction so as to turn rotation pin 31*a* and move shift arm 31*b* against shift element 28*b* thereby moving the shiftable locking member 26 toward side wall 14*b* and positioning such member so that the knob release spaces 27*a* are aligned with push knobs 25.

In a preferred embodiment of the display tray and security system of the invention four security tray mounts 34 are affixed to display case counter tops 20 in positions whereby the base member 11 of the display tray 10 may be easily seated over such mounts. Thus, appropriate openings 11*a* are provided in the base member 11 near the four corners of the tray and the mounts 34 are positioned to mate with such openings so that the tray seats thereon. The base member openings 11*a* are appropriately positioned near the corners of the tray so that they are in alignment with the downwardly extending tray security elements 24 of the rods 22 which are nearest each side wall 14*a* and 14*b* of the ring display tray. The tray mounts 34 are further positioned on the counter top 20 so that the channel 39 of each mount is aligned to receive the catch portion 24*a* of security elements 24. At the time of seating tray 10 on mounts 34, pressure is applied to the outermost push knobs to move their associated rods 22 (and their downwardly extending tray security elements 24) to a forward position so that the security elements 24, with their catch portions 24*a*, are free to enter their respective ring-shaped tray mounts. After seating the display tray on the tray mounts 34 the outermost push knobs are released and the rods 22 with security elements 24 move rearwardly by the action of springs S and the catch portions 24*a* of the security elements move into the respective channels 39 of the tray mounts 34 to lock the tray to the counter top. A locking key may then be applied to key cylinder 31 and locking member 26 shifted to a position whereby all push knobs 25 are prohibited from movement by the knob lock portions of locking member 26. With the display tray so positioned and locked it cannot be removed from the counter tops and items on display in the tray cannot be removed from their display position in the tray. When the tray is unlocked by key action it still cannot be lifted from the counter top without forward movement of the outer push knobs and rings or other items cannot be removed from the tray without forward movement of an appropriate push knob 25. The locking mechanisms of the security system of the invention are positioned toward the jewelry sales person and away from customers viewing the displayed items of a given display tray so that full control over the tray and release of displayed items is in the hands of the sales person.

While a preferred embodiment of the invention has been described, it is to be understood that such description is merely illustrative of the underlying principles of the invention and is not intended to be limiting of the scope of the invention and the following claims.

What is claimed is:

1. A store display tray for ring or loop shaped jewelry items including a security system for protecting against the theft of such items comprising:

(a) a display tray formed of a base member, a front wall, a rear wall, side walls and a top display member, said top member having a multiplicity of rows of slots therein for receiving the ring or loop shaped jewelry items to be displayed on said tray;

(b) a multiplicity of shiftable lock means within said tray and each positioned below and in alignment with a row of slots in said top display member, said shiftable lock means each having a portion thereof extending through the rear wall of said tray, said lock means bearing upwardly extending catch elements for locking engagement with the downwardly extending ring or loop shaped portion of the items displayed on the tray in the slots thereof when said lock means are in their respective lock positions, and one or more of said lock means bearing downwardly extending tray security elements for engagement with mounting means affixed to a counter top when said one or more lock means are in their respective lock position for locking said tray to said counter top;

(c) force biasing means comprising springs associated with each of said shiftable lock means and surrounding the extending portion thereof for maintaining said lock means in their lock positions; and (d) push knobs affixed to the end of the extending portion of each shiftable lock means for shifting said lock means to their respective unlock positions, said knobs positioned so that when a pushing force is applied thereto the springs surrounding said extending portions of said lock means are compressed and said lock means are shifted to their respective unlocked positions until said pushing force is terminated.

2. The display tray and security system as claimed in claim 1 wherein a shiftable locking member is provided in association with the rear wall of said tray, said locking member when shifted to its lock position restricts any movement of said shiftable lock means from their lock positions.

3. The display tray and security system as claimed in claim 2 wherein key lock means are provided through the top display member of said tray adjacent the rear wall thereof, said key lock means cooperating with said shiftable lock means whereby upon rotation of a key within said key lock means said shiftable lock means may be shifted to its lock position or its unlock position.

4. A theft proof display unit for finger rings comprising:

(a) a ring display tray formed of a base member, a front wall, a rear wall, side walls and a top ring display member, said top member having a multiplicity of rows of parallel slots therein for receiving the finger circling band portion of the rings to be displayed on said tray;

(b) a multiplicity of shiftable ring lock means within said tray with each positioned below and in alignment with a row of the slots in the top ring display member, said ring lock means each having a lock control component thereof extending through the rear wall of said tray, and each of said ring lock means bearing upwardly extending ring catch elements for ringlock engagement with the downwardly extending finger band portions of rings displayed on the tray in the slots thereof when said ring lock means are in their respective ring lock positions, and one or more of said lock means bearing downwardle extending tray security elements for engagement with mounting means affixed to a counter top when said one or more ring lock means are in their respective ring lock position for locking said tray to said counter top;

(c) force biasing means comprising springs associated with each of said shiftable ring lock means and surrounding the lock control component thereof for maintaining said ring lock means in their ring lock positions; and (d) push knobs affixed to the end of the lock control component of each of said shiftable ring lock means for shifting said lock means to their respective ring unlock positions, said knobs positioned so that when a pushing force is applied to the springs surrounding said lock control components of said lock means are compressed and said lock means are shifted to their respective unlock positions until said pushing force is terminated.

5. The theft proof display unit for finger rings as claimed in claim 4 wherein a shiftable locking member is provided in association with the rear wall of said tray, said locking member when shifted to its lock position restricts any movement of said shiftable ring lock means from their ring lock positions.

6. The theft proof display unit for finger rings as claimed in claim 5 wherein key lock means are provided through the top ring display member of said ring display tray adjacent the rear wall thereof, said key lock means cooperating with said shiftable locking member whereby upon rotation of a key within said key lock means said shiftable locking member may be shifted to its lock position or its unlock position.

* * * * *